US009138622B1

(12) United States Patent
DeMille et al.

(10) Patent No.: US 9,138,622 B1
(45) Date of Patent: Sep. 22, 2015

(54) MULTIPLE-MATERIAL IRON

(71) Applicant: Callaway Golf Company, Carlsbad, CA (US)

(72) Inventors: Brandon D. DeMille, Carlsbad, CA (US); Steven M. Ehlers, Poway, CA (US); Sean Griffin, Carlsbad, CA (US); James A. Seluga, Carlsbad, CA (US); Patrick Dawson, San Diego, CA (US); Denver Holt, Carlsbad, CA (US); Joshua D. Westrum, Vista, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 35 days.

(21) Appl. No.: 14/158,999

(22) Filed: Jan. 20, 2014

Related U.S. Application Data

(63) Continuation-in-part of application No. 13/767,751, filed on Feb. 14, 2013, now Pat. No. 8,974,317, which is a continuation-in-part of application No. 13/761,863, filed on Feb. 7, 2013, now Pat. No. 8,821,313.

(60) Provisional application No. 61/884,646, filed on Sep. 30, 2013, provisional application No. 61/701,533, filed on Sep. 14, 2012.

(51) Int. Cl.
*A63B 53/04* (2015.01)

(52) U.S. Cl.
CPC ..... *A63B 53/0475* (2013.01); *A63B 53/047* (2013.01); *A63B 2053/042* (2013.01); *A63B 2053/045* (2013.01); *A63B 2053/0412* (2013.01); *A63B 2220/64* (2013.01)

(58) Field of Classification Search
CPC ..... A63B 53/047; A63B 53/0475; A63B 2053/045; A63B 2053/0412; A63B 2220/64; A63B 2053/042
USPC ..... 473/324–350, 287–292
See application file for complete search history.

(56) References Cited

U.S. PATENT DOCUMENTS

| | | | | |
|---|---|---|---|---|
| 5,180,166 | A * | 1/1993 | Schmidt et al. | 473/332 |
| 7,169,057 | B2 * | 1/2007 | Wood et al. | 473/290 |
| 7,431,668 | B2 * | 10/2008 | Tateno et al. | 473/346 |
| 7,553,241 | B2 * | 6/2009 | Park et al. | 473/290 |
| 7,604,550 | B1 * | 10/2009 | Currie | 473/342 |
| 8,147,353 | B2 * | 4/2012 | Gilbert et al. | 473/345 |
| 8,323,121 | B2 * | 12/2012 | Wada et al. | 473/346 |
| 8,328,663 | B2 * | 12/2012 | Wahl et al. | 473/346 |
| 8,864,604 | B2 * | 10/2014 | Matsunaga | 473/346 |
| 8,920,261 | B2 * | 12/2014 | Taylor et al. | 473/350 |
| 2004/0009829 | A1 * | 1/2004 | Kapilow | 473/342 |
| 2004/0023730 | A1 * | 2/2004 | Nagai et al. | 473/345 |

(Continued)

*Primary Examiner* — Sebastiano Passaniti
(74) *Attorney, Agent, or Firm* — Rebecca Hanovice; Michael A. Catania; Sonia Lari

(57) ABSTRACT

The present invention discloses an iron-type golf club head formed from multiple materials that increase torsional stiffness of the club and aid in sound performance. In particular, the iron-type golf club head includes a body having top, sole, heel, toe, and face portions, a rear cavity, and a rear flange extending upwards from the sole portion, and a composite cap comprising a plurality of ribs covering the rear cavity and forming an internal cavity. The ribs can extend from an interior surface to an exterior surface of the composite cap, and in one embodiment, at least one of the ribs extends along an interior surface of the composite cap and hooks over the rear flange.

14 Claims, 6 Drawing Sheets

(56) References Cited

U.S. PATENT DOCUMENTS

2005/0221913 A1* 10/2005 Kusumoto ..... 473/345
2005/0250596 A1* 11/2005 Chuang ..... 473/345
2007/0042833 A1* 2/2007 Gilbert et al. ..... 473/332
2008/0070721 A1* 3/2008 Chen et al. ..... 473/346
2009/0131199 A1* 5/2009 Gilbert et al. ..... 473/332
2010/0062875 A1* 3/2010 Hoffman et al. ..... 473/346

* cited by examiner

MULTIPLE-MATERIAL IRON

CROSS REFERENCES TO RELATED APPLICATIONS

The present application claims priority to U.S. Provisional Patent Application No. 61/884,646, filed on Sep. 30, 2013, and is a continuation-in-part of U.S. patent application Ser. No. 13/767,751, filed on Feb. 14, 2013, which is a continuation-in-part of U.S. patent application Ser. No. 13/761,863, filed on Feb. 7, 2013, which claims priority to U.S. Provisional Patent Application No. 61/701,533, filed on Sep. 14, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a multiple-material iron-type golf club head. More specifically, the present invention relates to an iron-type golf club with composite material disposed on or over a rear surface of the golf club head.

2. Description of the Related Art

The prior art discloses various types of golf club heads having multiple materials, and various types of golf club heads with sound-enhancing features. There is a need for a golf club head having multiple material configurations that both benefit sound and enhance the mass properties of the golf club head.

BRIEF SUMMARY OF THE INVENTION

The present invention provides an iron-type golf club with features that optimize both sound and mass properties, including moment of inertia, center of gravity (CG) location, and the overall weight of the golf club head.

One aspect of the present invention is an iron-type golf club head comprising a cavity and a composite back cap. Another aspect of the present invention is an iron-type golf club head comprising a back flange and a thin layer of composite affixed to a surface of the back flange.

Yet another aspect of the present invention is an iron-type golf club head comprising a face component, a body having a top portion, a sole portion, a heel portion, a toe portion, a rear cavity, and a rear flange extending upwards from the sole portion, and a composite material affixed to at least part of an external surface of the rear flange. In some embodiments, the composite material may be a 45 degree composite, meaning that, if the zero degree direction of the fiber orientation is in a heel-toe direction, and the 90 degree direction is normal to a ground plane, the composite layups are predominantly made of up fibers oriented at +45 degrees and −45 degrees. Layups of this type are particularly stiff in shear and provide the most efficient means of increasing the heel-toe twisting modal frequency (typically the second mode for irons) and decreasing its amplitude upon impact with a ball. Reducing the amplitude will result in a more solid sound and feel at impact. In other embodiments, the composite material may have a constant thickness of no less than 0.001 inch and no more than 0.500 inch, or it may have a variable thickness ranging from 0.001 inch to 0.500 inch.

In still other embodiments, the face component may be a face plate, and the rear flange may comprise a forward extending portion. In a further embodiment, the face plate may be welded to the top portion, sole portion, heel, and toe of the body, and may be brazed to a forwardmost surface of the forward extending portion. In another further embodiment, the iron-type golf club head may comprise a cavity enclosed by the heel, toe, flange, forward extending portion, and face plate, which may be filled with a lightweight material selected from the group consisting of composite, plastic, rubber, and aluminum alloy. In some embodiments, the face plate may compose part of the top portion and part of the sole portion.

In other embodiments, the face component may be a face insert. In some embodiments, the composite material may be affixed to the flange with an adhesive material, and may be affixed to an entire rear surface of the flange. The body of the iron-type golf club head may be composed of a metal alloy material, and the flange may extend upwards from the sole portion and makes contact with the top portion. In some embodiments, the composite material may be affixed to an upper end of the flange and extends upward to make contact with the top portion. In a further embodiment, this composite material may enclose the rear cavity.

Another aspect of the present invention is a set of iron-type golf clubs comprising a first club head comprising a body with a first rear flange, a first face place, and a first composite component, and a second club head comprising a body with a second rear flange, a second face plate, and a second composite component, wherein the first composite component is affixed with adhesive to an external surface of the first rear flange, wherein the second composite component is affixed with adhesive to an external surface of the second rear flange, wherein the thickness of the first rear flange is greater than the thickness of the second rear flange, and wherein the thickness of the first composite component is smaller than the thickness of the second composite component.

Yet another aspect of the present invention is an iron-type golf club head comprising a face plate, a body having a top portion, a sole portion, a heel portion, a toe portion, a rear cavity, and a rear flange extending upwards from the sole portion, and a composite material affixed with adhesive to the entire rear, external surface of the rear flange, wherein the composite material is composed of 45 degree carbon composite with a constant thickness of no less than 0.001 inch and no more than 0.050 inch, wherein the rear flange comprises a forward extending portion, wherein the face plate is welded to the top portion, sole portion, heel portion, and toe portion of the body, and wherein the face plate is brazed to a forwardmost surface of the forward extending portion. In some embodiments, the composite material may be affixed to the top portion of the body and enclose the rear cavity. In other embodiments, the face plate may be composed of a first material having a first density, the body may be composed of a second material having a second density, and the first density may differ from the second density.

Another aspect of the present invention is an iron-type golf club head comprising a body having a top portion, a sole portion, a heel portion, a toe portion, a rear cavity, a face portion, and a rear flange extending upwards from the sole portion, and a composite cap affixed to the body, wherein the composite cap covers the rear cavity, forming an internal cavity, and wherein the composite cap comprises a plurality of ribs. In one embodiment, the plurality of ribs may comprise at least three ribs. In another embodiment, at least one of the plurality of ribs may extend from an interior surface of the composite cap to an exterior surface of the composite cap. In some embodiments, at least one of the plurality of ribs may extend along an interior surface of the composite cap and hook over the rear flange. In a further embodiment, the at least one rib may make contact with an interior surface of the sole portion.

In another embodiment, the composite cap may be affixed to at least a part of the top portion, the heel portion, the toe portion, and the rear flange. In some embodiments, the composite cap may be affixed to the body with an adhesive material. In other embodiments, at least one of the plurality of ribs may extend in a vertical direction. In one embodiment, golf club head may have a first mode measurement of at least 3000 Hz and a second mode measurement of at least 3250 Hz. In a further embodiment, the first mode measurement may be 3500-6000 Hz and the second mode measurement may be 3750-6250 Hz. In another, further embodiment, the first mode measurement may be 3750-5750 Hz and the second mode measurement may be 4000-6000 Hz. In yet another further embodiment, the first mode measurement may be 4250-5000 Hz and the second mode measurement may be 4500-5500.

In another embodiment, at least one of the plurality of ribs may extend along an exterior surface of the composite cap. In some embodiments, the composite cap may be affixed to at least one of an exterior surface and an interior surface of the body. In another embodiment, each of the plurality of ribs may be entirely contained within the internal cavity. In another embodiment, the composite cap may comprise a variable thickness of no less than 0.001 inch and no more than 0.500 inch. In another embodiment, the body may be integrally formed from a stainless steel material. In yet another embodiment, the face portion may be formed separately from the top portion, sole portion, heel portion, toe portion, and rear flange of the body, and may be a face plate, a face cup, or a face insert.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
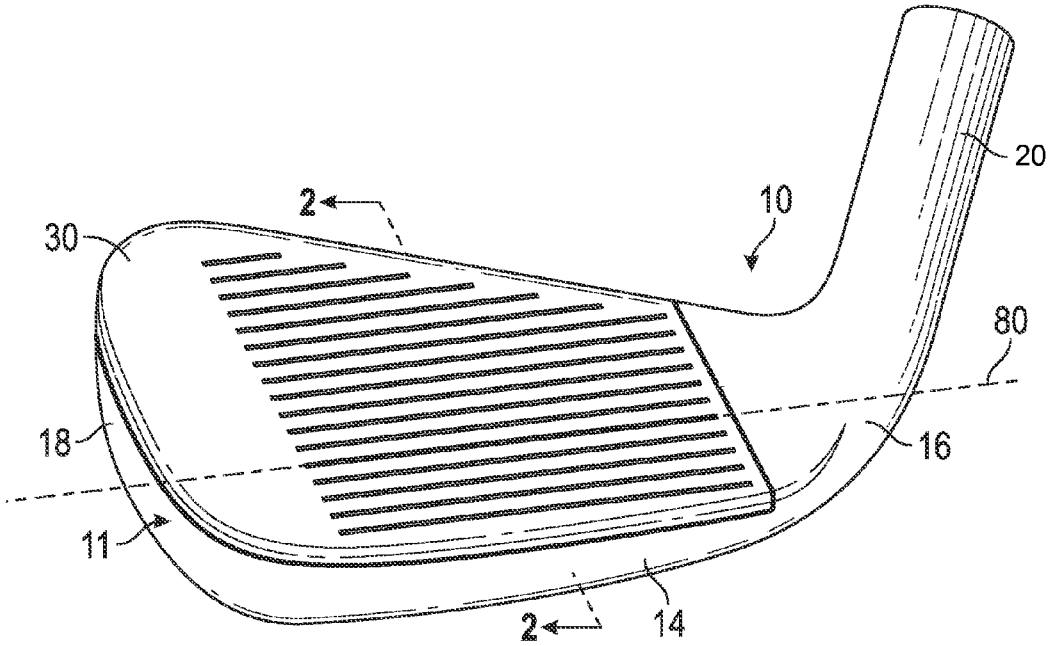
FIG. 1 is a front perspective view of a first embodiment of the present invention.
Figure 2:
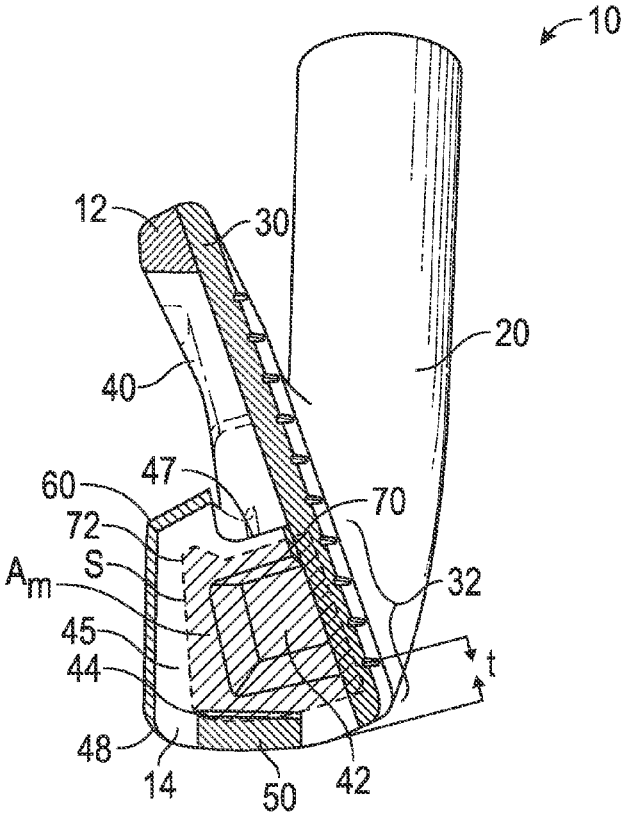
FIG. 2 is a cross-sectional view of the first embodiment along lines 2-2.
Figure 4:
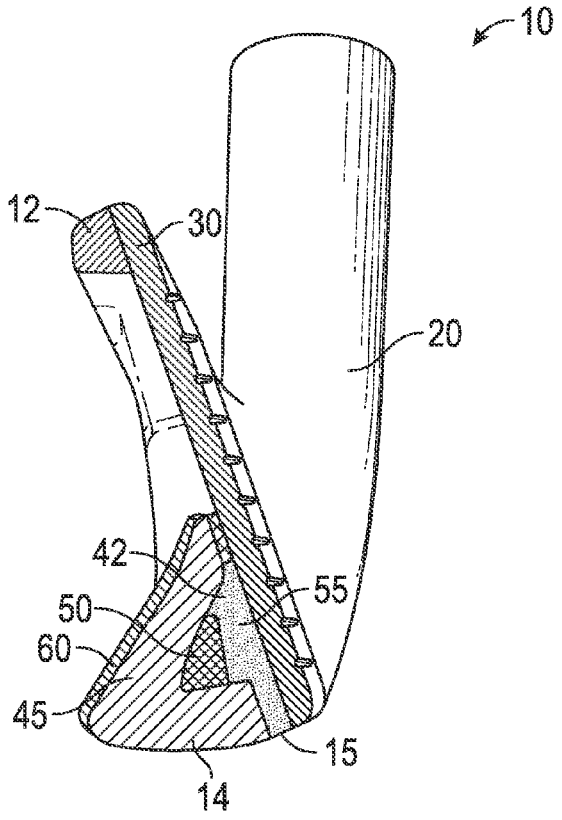
FIG. 4 is a cross-sectional view of the second embodiment along lines 4-4.

A first embodiment of the iron-type golf club head 10 of the present invention is shown in FIGS. 1-2. The golf club head 10 has a top portion 12 (also called a top rail), a sole portion 14, a heel portion 16, a toe portion 18, a hosel 20, a face plate 30, a rear cavity 40, and a rear flange 45 that extends from and is approximately perpendicular to the rearmost edge of the sole portion 14. The face plate 30 extends from a lowermost edge of the sole portion 14 to an uppermost edge of the top portion 12, is welded to both of these parts, and forms part of the surface of the top portion 12 and the sole portion 14 as shown in FIG. 4. In alternative embodiments, however, the face plate 30 may function as a face insert and not extend completely from the lowest edge of the sole portion 14 to the uppermost edge of the top portion 12.

The rear flange 45 includes a forward projecting portion 47 that extends from and is approximately perpendicular to the rear flange 45, and extends towards the face plate 30. The face plate 30 preferably is brazed to a forwardmost surface of the forward projecting portion 47, though in alternative embodiments the face plate 30 may be welded, glued, or otherwise affixed to the forward projecting portion 47. The golf club head 10 also includes an internal cavity 42 that is bounded by the rear flange 45, the forward projecting portion 47, the heel portion 16, the toe portion 18, and the face plate 30, and a sole cavity 44 that is filled with a high-density weight 50. The internal cavity 42 may be filled with any material known to a person skilled in the art, but preferably is left empty to reduce the overall weight of the golf club head 10.

The lower portion of the iron club head shown in FIG. 2 behaves in torsion about an axis 80 extending from the heel to toe as a closed cell beam. The closed cell 70 surrounds the internal cavity 42 and is composed of the rear flange 45, the forward projecting portion 47, a lower portion 32 of the face plate 30, and the sole portion 14. It is considered closed by the existence of the connection of the forward projecting portion 47 with the face plate 30 by brazing, welding, bonding or other means of affixing the two components. The torsional rigidity, GJ, of a closed cell section can be approximated by:

$$GJ = \frac{4A_m^2}{\oint \frac{ds}{Gt}}$$

where s is the closed cell contour coordinate which follows a wall midplane 72 around the cross-section, ds is a differential element of that coordinate, G is the shear modulus of elasticity of the wall material, t is the local wall thickness perpendicular to the midplane contour, and $A_m$ is the area enclosed by the midplane of the thickness around the closed cell contour.

Torsional rigidity, GJ, of the lower portion of an iron-type club head 10 can be increased by adding carbon composite sheet 60 to the cross-section as shown in FIG. 2. The composite sheet 60 preferably is affixed with an adhesive to a rear surface of the rear flange 45. This composite sheet 60, which has a thickness ranging from 0.001 to 0.500 inch, preferably extends from the point 48 at which the sole portion 14 contacts the rear flange 45 to the top most surface of the rear flange 45, and more preferably covers the entire rear surface of the rear flange 45, though in some embodiments the composite sheet 60 may extend onto or be solely affixed to the sole portion 14. The composite sheet 60, which preferably is composed of a multi-directional composite laminate, and most preferably by composite composed of plies oriented at ±45 degrees with respect the heel to toe axis 80 (which is perpendicular to the plane of the cross-section shown in FIG. 2), increases the torsional stiffness of the golf club head 10 while at the same time improving sound performance. While fiber orientations other than ±45 degrees can be used, the ±45 degree orientation allows for the greatest increase in shear modulus of elasticity, and lower angles will have less effect on torsional rigidity. In another embodiment, the composite sheet 60 is composed of a single ply of composite prepreg with a thickness of approximately 0.005 inch.

When a composite sheet 60 is included with the golf club head 10 as shown in FIG. 2, the variable G is replaced by the effective shear modulus, $G_{eff}$, of the combined carbon composite and parent material, which is given by;

$$G_{eff} = \frac{G_1 t_1 + G_2 t_2}{t_1 + t_2}$$

where, $G_1$ is the shear modulus of elasticity of the parent material, $t_1$ is the thickness of the parent material, $G_2$ is the shear modulus of elasticity of the carbon composite material, $t_2$ is the thickness of the carbon composite material, and t=total thickness of the carbon composite plus the parent material=$t_1+t_2$.

An additional benefit of using carbon composite with the golf club head 10 of the present invention is its low density relative to materials typically used in the face, sole and flange of irons. As a result, a significant increase in torsional stiffness can be achieved at a very low mass. This approach allows the vibration and feel properties of the head to be improved without adversely affecting key mass properties such as center of gravity location. The inherent damping properties of composite materials and the adhesive bond joining it to the parent structure also improve the impact feel and sound properties of the club head.

Figure 3:
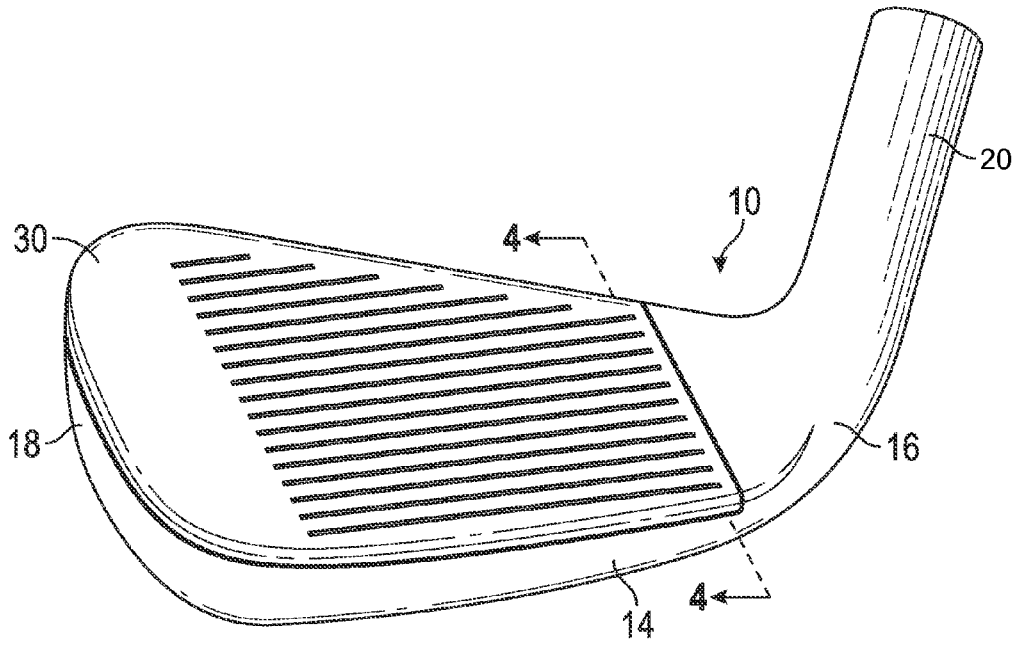
FIG. 3 is a front perspective view of a second embodiment of the present invention.

A second embodiment of the golf club head 10 is shown in FIGS. 3-4. Like the first embodiment, this embodiment includes a face plate 30 affixed to a body having a top portion 12, sole portion 14, heel portion 16, toe portion 18, hosel 20, rear cavity 40, and rear flange 45, though in this embodiment the rear flange 45 extends diagonally upwards from a rearward-most edge of the sole portion 14 and projects towards the face plate 30. As in the preferred embodiment, this embodiment includes a composite sheet 60 that is adhered to and covers the entire rear surface of the rear flange 45.

As shown in FIG. 4, the face plate 30 is affixed to a forwardmost surface of the rear flange 45 via brazing. Together with the sole portion 14, heel portion 16, toe portion 18, and face plate 30, the rear flange 45 creates an internal cavity 42, which in this embodiment includes a high-density weight 50, which preferably is composed of a tungsten alloy. Any additional space within the internal cavity 42 is filled with a low density polymer material 55 to improve the resilience of the face. This polymer material 55, which preferably is a rubber material, is injected through a hole 15 in the sole portion 14, which can be closed off with a simple plug (not shown).

Figure 5:
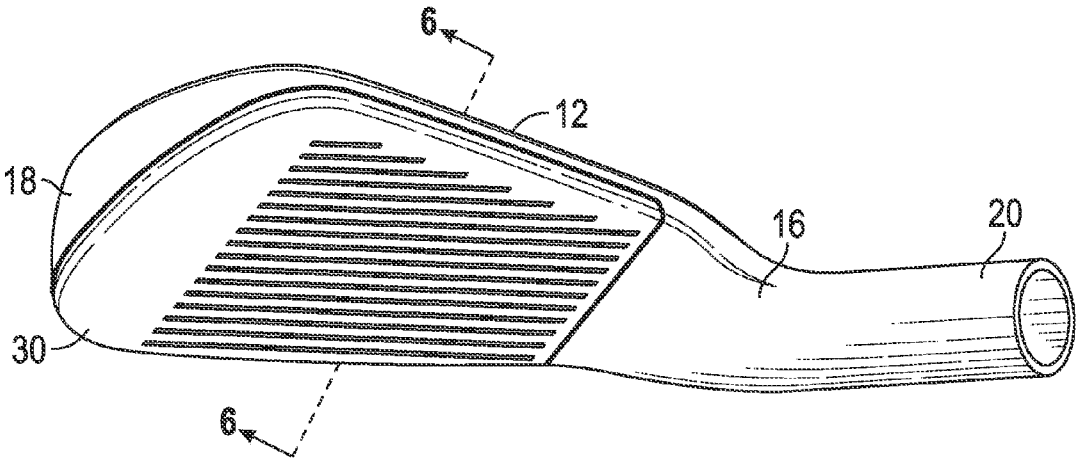
FIG. 5 is a top, perspective view of a third embodiment of the present invention.
Figure 6:
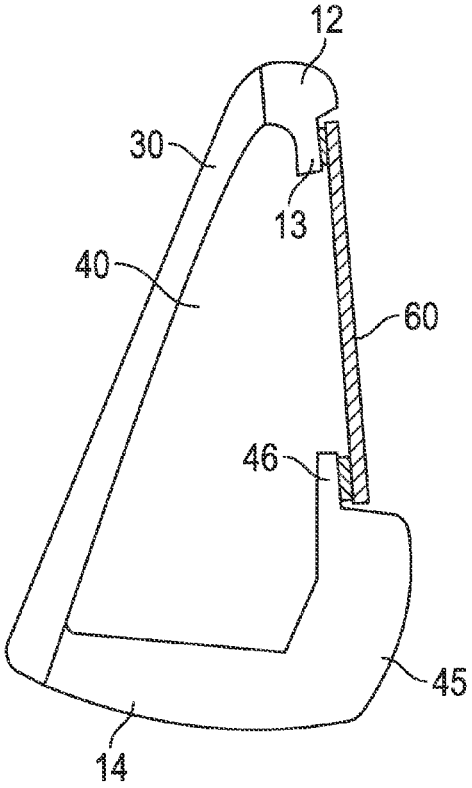
FIG. 6 is a cross-sectional view of the third embodiment along lines 6-6.
Figure 7:
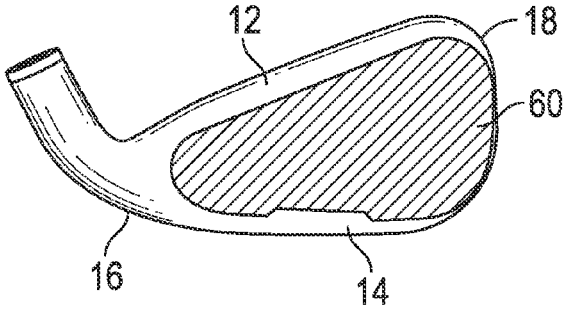
FIG. 7 is a rear perspective view of the third embodiment shown in FIG. 5.

In a third embodiment, shown in FIGS. 5-7, the composite sheet 60 is affixed to a first lip 46 extending from the rear flange 45 and a second lip 13 extending from a lower surface of the top portion 12, and in this way closes the rear cavity 40 of the golf club head 10.

Figure 8:
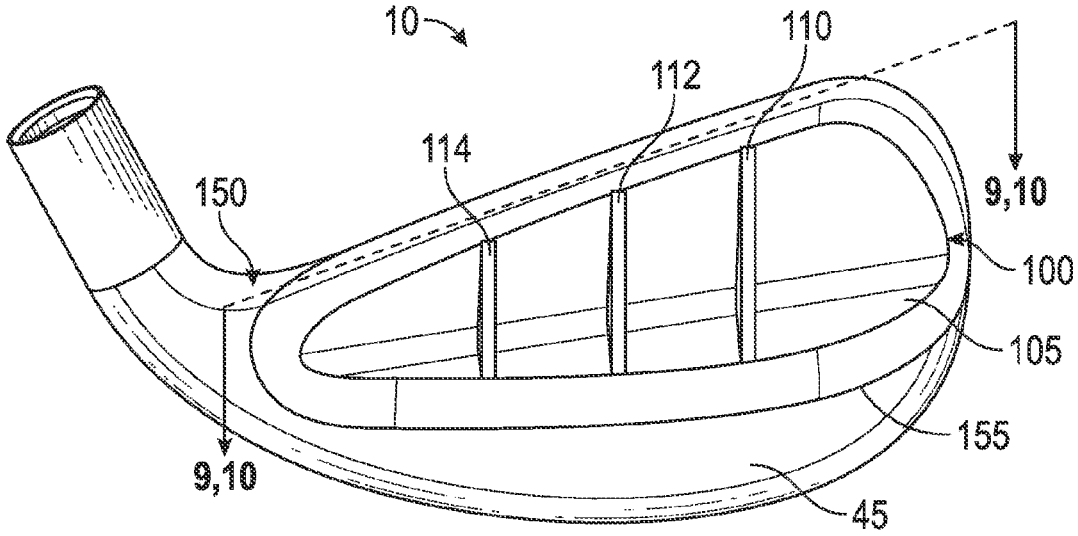
FIG. 8 is a rear perspective view of a fourth embodiment of the present invention.
Figure 9:
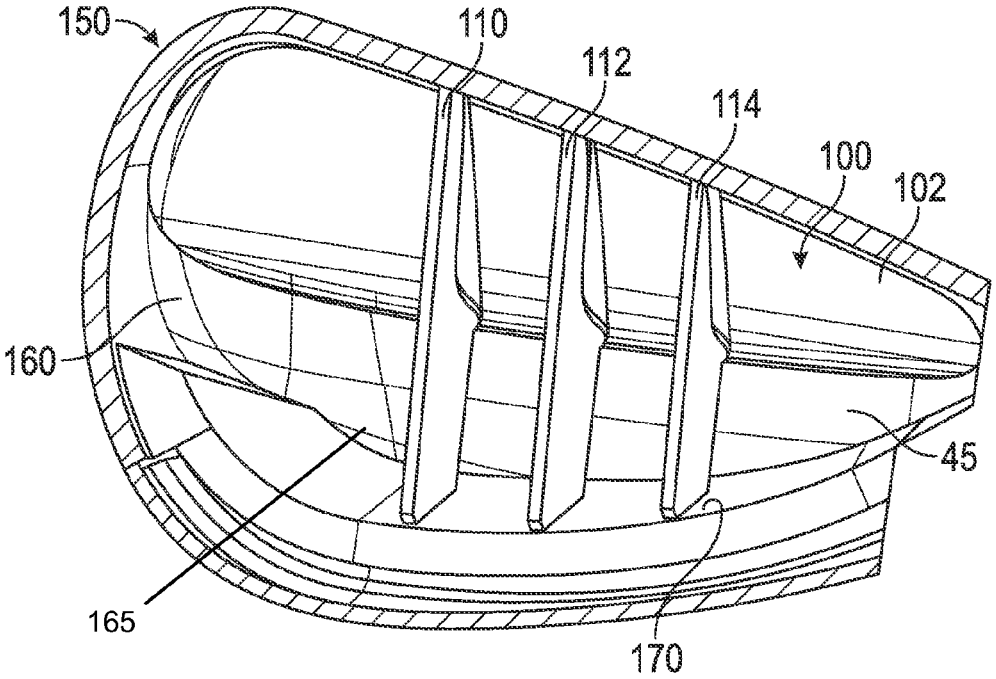
FIG. 9 is a cross-sectional view of the fourth embodiment shown in FIG. 8 along lines 9-9.
Figure 10:
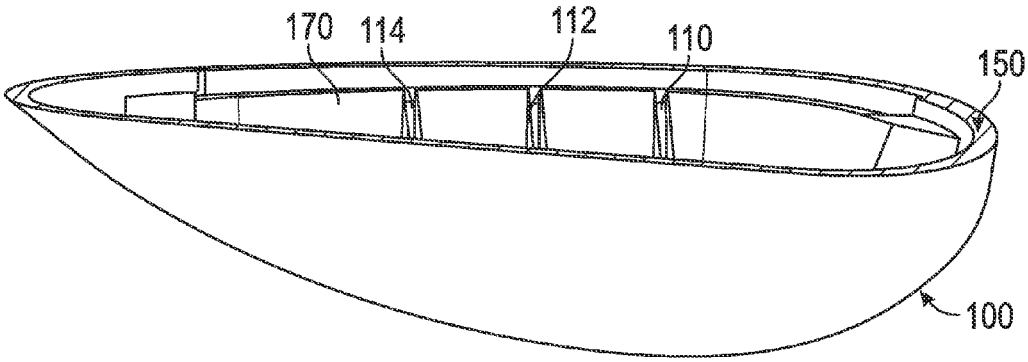
FIG. 10 is a top perspective view of the cross-sectional view shown in FIG. 9.

A fourth, preferred embodiment of the golf club head 10 is shown in FIGS. 8-10. This golf club head 10 includes a face 120 that is integrally formed with the body 150 via casting, forging, forming, or another method known to a person skilled in the art, but in alternative embodiments may have the construction shown in FIGS. 1-7. In this preferred embodiment, the composite sheet 60 is molded into a composite cap 100 comprising a plurality of ribs 110, 112, 114 or corrugations, which is affixed to the body 150 of the golf club head 10 to form an interior cavity 160. The composite cap 100 preferably is affixed to the body 150 with an adhesive, and makes contact with at least a portion of an outer surface 155 of the body 150.

The ribs 110, 112, 114 provide the composite cap 100 with a variable thickness ranging from 0.001 to 0.500 inch. The ribs 110, 112, 114 in the preferred embodiment extend from the interior surface 102 of the composite cap 100 to the exterior surface 105 of the composite cap 100 as shown in FIGS. 8 and 9, but in other embodiments may be disposed only on the interior surface 102 or exterior surface 105 of the composite cap 100. The ribs 110, 112, 114 in this embodiment extend in a vertical direction, but in other embodiments may extend horizontally or diagonally across the composite cap 100.

As shown in FIG. 9, the ribs 110, 112, 114 hook over the rear flange 45 of the golf club head 10 and extend into a lower region 165 of the interior cavity 160, resting against an interior sole surface 170, thus providing greater structural support and improving the club head's 10 acoustics when it is use. In the case of a 3-iron, for example, the composite cap 100 with the ribs 110, 112, 114 shown in FIGS. 8-10 100 causes the golf club head 10 to have sound measurements of at least 3000 Hz for mode 1 and at least 3250 Hz for mode 2, more preferably 3500-6000 Hz for mode 1 and 3750-6250 Hz for mode 2, even more preferably 3750-5750 Hz for mode 1 and 4000-6000 Hz for mode 2, and most preferably 4250-5000 Hz for mode 1 and 4500-5500 Hz for mode 2. These modes may be calculated using finite element analysis, or may be measured experimentally using any method known to a person skilled in the art, including, but not limited to, using a hammer and accelerometers.

Figure 11:
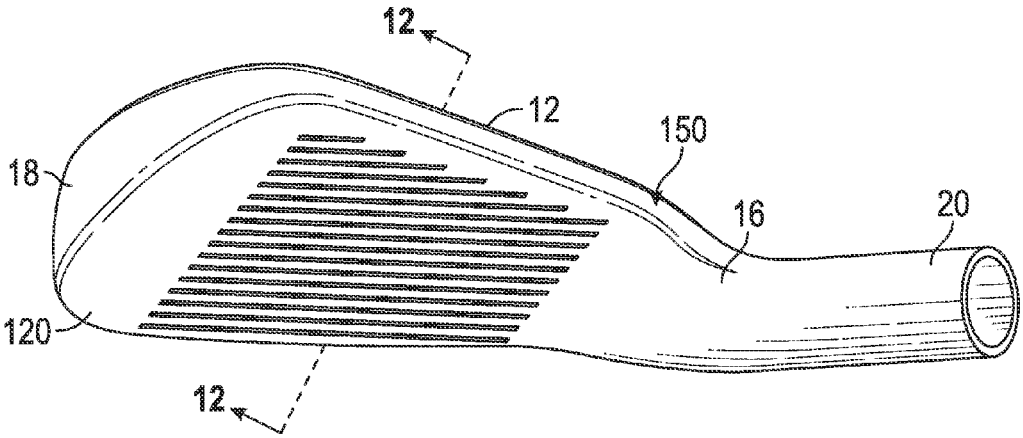
FIG. 11 is a top, perspective view of a fifth embodiment of the present invention.
Figure 12:
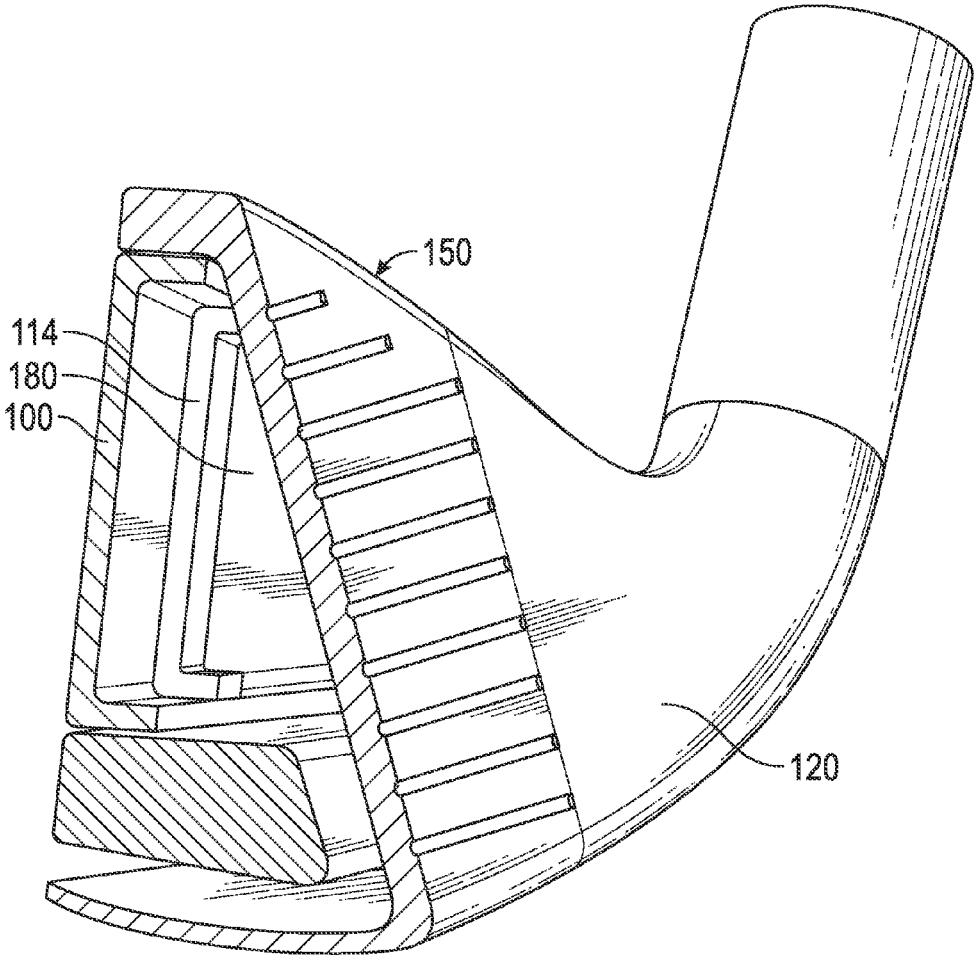
FIG. 12 is a cross-sectional view of the fifth embodiment shown in FIG. 11 along lines 12-12.

In another embodiment, shown in FIGS. 11-12, the composite cap 100 of the present invention is combined with one of the embodiments disclosed in U.S. patent application Ser. No. 13/797,507, the disclosure of which is hereby incorporated by reference in its entirety herein. In this embodiment, the composite cap 100 is bonded to an inside surface of the golf club head 10 body 150, forming an interior cavity 180. In this embodiment, the ribs 110, 112, 114 do not make contact with any part of the body 150 of the golf club head 10, but in other embodiments may extend away from the composite cap 100 to make contact with an interior surface of the body 150.

In other embodiments, the composite sheet 60 and/or composite cap 100 of the present invention may be used in connection with the embodiments disclosed in U.S. patent application Ser. No. 13/761,863, the disclosure of which is hereby incorporated by reference in its entirety herein.

In any of the embodiments disclosed herein, the composite sheet 60 and/or composite cap 100 of the present invention may be formed from composite made according to the processes disclosed in U.S. Pat. Nos. 8,529,370 and 8,460,123, the disclosure of each of which is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body having a top portion, a sole portion, a heel portion, a toe portion, a rear cavity, a face portion, and a rear flange extending upwards from the sole portion; and a composite cap affixed to the body, wherein the composite cap covers the rear cavity, forming an internal cavity, wherein the composite cap comprises a plurality of vertical ribs, wherein the plurality of ribs comprises at least three ribs, wherein each of the plurality of ribs extends along an interior surface of the composite cap and hooks over the rear flange, wherein each of the plurality of ribs extends into a lower region of the internal cavity, wherein at least one of the plurality of ribs makes contact with an interior surface of the sole portion, wherein the composite cap is composed of a 45 degree composite material, wherein the composite cap has a thickness of no less than 0.001 inch and no more than 0.500 inch, and wherein the golf club head has a first mode measurement of at least 3000 Hz and a second mode measurement of at least 3250 Hz.

2. The iron-type golf club head of claim 1, wherein at least one of the plurality of ribs extends from an interior surface of the composite cap to an exterior surface of the composite cap.

3. The iron-type golf club head of claim 1, wherein the composite cap is affixed to at least a part of the top portion, the heel portion, the toe portion, and the rear flange.

4. The iron-type golf club head of claim 1, wherein the composite cap is affixed to the body with an adhesive material.

5. The iron-type golf club head of claim 1, wherein the golf club head has a first mode measurement of 3500-6000 Hz and a second mode measurement of 3750-6250 Hz.

6. The iron-type golf club head of claim 5, wherein the golf club head has a first mode measurement of 3750-5750 Hz and a second mode measurement of 4000-6000 Hz.

7. The iron-type golf club head of claim 6, wherein the golf club head has a first mode measurement of 4250-5000 Hz and a second mode measurement of 4500-5500.

8. The iron-type golf club head of claim 1, wherein the composite cap is affixed to at least one of an exterior surface and an interior surface of the body.

9. The iron-type golf club head of claim 1, wherein each of the plurality of ribs is entirely contained within the internal cavity.

10. The iron-type golf club head of claim 1, wherein the composite cap comprises a variable thickness.

11. The iron-type golf club head of claim 1, wherein the body is integrally formed from a stainless steel material.

12. The iron-type golf club head of claim 1, wherein the face portion is formed separately from the top portion, sole portion, heel portion, toe portion, and rear flange of the body.

13. The iron-type golf club head of claim 12, wherein the face portion is a face plate.

14. The iron-type golf club head of claim 12, wherein the face portion is a face insert.

* * * * *